United States Patent [19]

Hobart

[11] 4,090,432

[45] May 23, 1978

[54] GUIDING AN ELONGATE SHEET OF PACKAGING MATERIAL

[75] Inventor: Jack Hobart, Leamington Spa, England

[73] Assignee: Hobart Engineering Limited, England

[21] Appl. No.: 767,115

[22] Filed: Feb. 9, 1977

[51] Int. Cl.[2] ..... B65H 25/26

[52] U.S. Cl. ..... 93/20; 93/82; 93/94 R; 226/21

[58] Field of Search ..... 93/20, 82, 94 R, 1 F; 226/21, 22, 15, 18; 53/28

[56] References Cited

U.S. PATENT DOCUMENTS

| | | | |
|---|---|---|---|
| 2,771,252 | 11/1956 | Johnson | 226/22 X |
| 2,777,069 | 1/1957 | Saeman | 226/21 X |
| 3,313,461 | 4/1967 | Andersen | 226/22 UX |
| 3,380,637 | 4/1968 | Knapp | 226/21 X |
| 3,533,542 | 10/1970 | Ziebolz et al. | 226/22 |
| 3,680,446 | 8/1972 | James et al. | 93/20 X |

*Primary Examiner*—James F. Coan

*Attorney, Agent, or Firm*—Finnegan, Henderson, Farabow & Garrett

[57] ABSTRACT

A method of and apparatus for guiding an elongate sheet of packaging material towards a former which manipulates the sheet into a tube having its longitudinal edges slightly overlapped to enable them to be formed into a seam, the sheet being caused initially to drift sideways in one direction as it is drawn towards the former, a detector being provided for detecting when one longitudinal edge of the sheet has drifted to a first predetermined position, the sheet then being caused to drift sideways in the opposite direction until the said one longitudinal edge of the sheet has drifted to a second predetermined position after which the sheet is caused to drift sideways again in the said one direction.

16 Claims, 5 Drawing Figures

GUIDING AN ELONGATE SHEET OF PACKAGING MATERIAL

The invention relates to a method of, and apparatus for, guiding an elongate sheet of packaging material towards a former for manipulating the sheet into a tube.

Batch weighing machines for light-weight, free-flowing products, such as potato crisps, commonly form an elongate sheet of packaging material, such as transparent packaging film, into a tube which is later divided into individual packets of the product. This is achieved by drawing a tensioned roll of packaging material through a former. Such formers usually comprise a pre-former that is secured at an acute angle to an upright tubular support body, having an internal diameter corresponding closely with the external diameter of the tube which is to be formed. The sheet is drawn over the curved surface of the pre-former section and is then reversely directed through the tubular support body thereby manipulating the sheet into a tube having its longitudinal edges slightly overlapped. After passing through the tubular support body, these overlapped edges pass a stationary sealing head which causes them to adhere to each other. A transition line is defined by the intersection between the tubular support body and the pre-former portion, and the transition line and the surface of the pre-former portion are carefully designed so that the sheet is smoothly manipulated into a tube without tearing or crinkling. After the overlapped edges of the tube have been adhered together, the tube passes a transverse sealing and cutting head which is arranged to flatten the tube transversely, seal the opposite sides together, and then separate the tube transversely through the middle of the transverse seal. In this manner, the top of one bag and the bottom of an adjacent bag are formed simultaneously. Each bag is charged with product by discharging a predetermined quantity of the product into the top of the tubular support body so that the product will fall into the partly formed bag to be supported by the last made bottom seal. The product is then packed downwards by a stripping device before the next transverse seal is made to complete and separate the packaged bag.

If the overlapped edges of the sheet of packaging material move transversely out of alignment with the stationary sealing head, the longitudinal seal of the resultant packed bag will not be properly formed, and the contents of the bag may consequently spill out or otherwise deteriorate.

An object of the invention is to enable an elongate sheet of packaging material to be guided towards the former so that its overlapped longitudinal edges will be accurately positioned.

According to one aspect of the invention a method of guiding an elongate sheet of packaging material towards a former which manipulates the sheet into a tube having its longitudinal edges slightly overlapped to enable them to be formed into a seam, includes causing the sheet to drift sideways in one direction as it is drawn towards the former, detecting when one longitudinal edge of the sheet has drifted to a first predetermined position, then causing the sheet to drift sideways in the opposite direction until the said one longitudinal edge of the sheet has drifted to a second predetermined position, and then causing the sheet to drift sideways again in the said one direction.

According to another aspect of the invention apparatus, for guiding an elongate sheet of packaging material towards a former which manipulates the sheet into a tube having its longitudinal edges slightly overlapped to enable them to be formed into a seam, comprises a guide for moving the sheet sideways in either direction as it is drawn towards the former, a detector for identifying the presence or absence of one longitudinal edge of the sheet, the guide being arranged to move the said one longitudinal edge of the sheet sideways towards the detector, the detector on sensing the presence of the one longitudinal edge of the sheet being arranged to cause a reverse sideways movement of the sheet to occur until the said one longitudinal edge of the sheet is no longer identified by the detector whereupon the guide will again move the said one longitudinal edge of the sheet sideways towards the detector.

The guide may include rollers for guiding the sheet towards the former, one of said rollers being mounted for tipping relatively to the others to cause the sheet to drift sideways in either direction. Control means may be provided for altering the inclination of said one roller, the control means being arranged to tip the roller slightly in one direction to cause the said one longitudinal edge of the sheet to drift in that direction towards the detector, the detector on sensing the presence of the one longitudinal edge of the sheet being arranged to operate the control means to reverse the inclination of said one roller whereby the sheet will drift in the opposite direction until the one longitudinal edge of the sheet is no longer identified by the detector whereupon the detector will operate the control means to tip said one roller slightly in the said one direction again. Said one roller may be supported intermediate its ends by a self-aligning bearing and may have one of its ends connected to the control means. Alternatively, the roller may have one of its ends supported by a self-aligning bearing and may have its opposite end connected to the control means. The control means is preferably a crank which is driven by a servo motor actuated by the detector, the outer end of the crank supporting the guide roller through a self aligning bearing device. The servo motor is preferably connected to the crank through a slipping clutch, and a separate manual control may be provided for altering the position of the crank. Alternatively, the control means may include a cam having a surface so shaped that movement of the cam will tip the said one roller. The cam surface may engage bearing means on said one roller. Preferably, means is provided for stopping movement of the cam if an extremity of the cam reaches or moves close to the bearing. The detector is preferably mounted for adjustment transversely of the sheet of packaging material whereby the overlapped longitudinal edges of the sheet may be adjusted relatively to a sealing head which forms the seam.

Alternatively the guide for moving the sheet sideways in either direction may alter the axial position of a roll of the packaging material along a spindle or other roll-supporting device. The sheet of packaging material is preferably kept under a predetermined tension by tensioning means.

The invention is now described, by way of example only, with reference to the accompanying drawings, in which.

Figure 1:
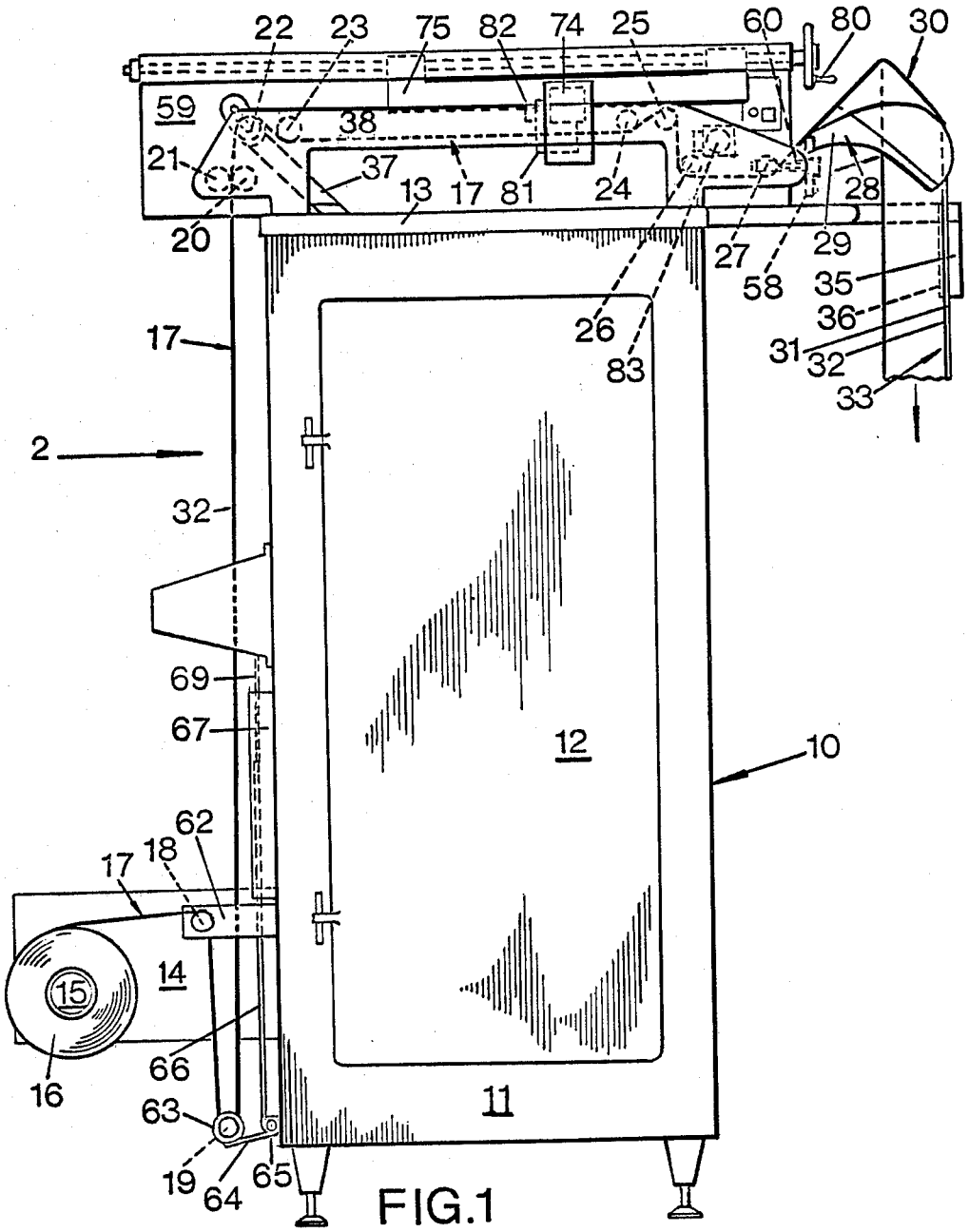
FIG. 1 is a side elevation of part of a form and fill packaging machine according to the invention.

With reference to the accompanying drawings, a free-standing cabinet is indicated generally at 10 and comprises a base portion 11 provided with a hinged axis door 12 and a top plate 13. A casing 14 projects from the back of the cabinet 10 near its base and supports a pair of aligned horizontal spindles 15, only one of which is shown. A roll 16 of transparent pre-printed packaging film 17 is fitted coaxially over each spindle 15 to be driven thereby, and the film is then taken through a series of guide rollers 18, 19, 20, 21, 22, 23, 24, 25, 26 and 27 to a former 28. It will be noted that the guide roller 27 is arranged so that the packaging film 17 will be drawn smoothly over a curved preformer surface 29 before it is reversely directed through an aperture 30 defined by the former 28. In this manner the packaging film 17 is manipulated into a tube having its longitudinal edges 31 and 32 overlapped as indicated by reference 33 in FIG. 1. A transition line 34 is defined by the intersection between the curved preformer surface 29 and the aperture 30 and is carefully designed so that the packaging film 17 will be manipulated smoothly into a tube without tearing or crinkling. A stationary sealing head 35 is carried from the top plate 13 and has a tongue 36 extending downwardly within the tube formed by the packaging film 17 whereby the overlapped edges 31 and 32 will be adhered together as the packaging film 17 is drawn past the stationary sealing head 35. Unless the packaging film 17 is accurately positioned on the various guide rollers 18 - 27, the overlapped longitudinal edges 31 and 32 of the packaging film 17 will not be correctly aligned with the stationary sealing head 35, and the tube of packaging material will be incorrectly formed.

Figure 4:
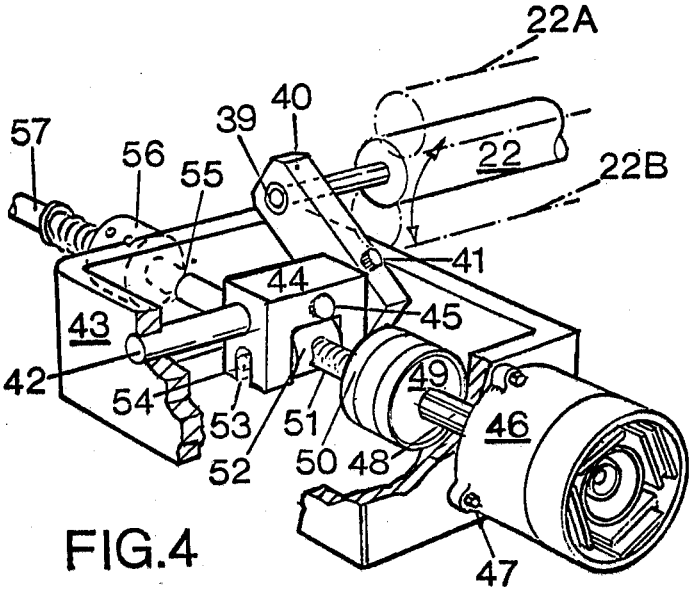
FIG. 4 is an enlarged perspective view of the mechanism for tipping a guide roller, the view being taken generally in the direction of arrow 4 in FIG. 3.

In order to direct the packaging film 17 accurately towards the former 28, and consequently the stationary sealing head 35, the guide roller 22 (constituting the aforesaid "one roller") is mounted for tipping slightly out of the true horizontal. This is achieved by supporting the middle of the guide roller 22 with a self aligning bearing which is carried by a pedestal 37 secured to the top plate 13. One end of the guide roller 22 is positioned with working clearance from a side plate 38 secured to the top plate 13, and the opposite end of the guide roller 22 is supported by a second self aligning bearing 39 carried by the outer end of a movable crank 40 which is best seen in FIG. 4. The guide roller 22 may alternatively be supported at one end by the self aligning bearing 39 and at the other end by a second self aligning bearing carried by the side plate 38. From FIG. 4 it will be noted that the crank 40 is secured by a set screw 41 to a horizontal pivot 42 of which the ends are journalled as shown in a casing 43 also carried by the top plate 13. The horizontal pivot 42 extends through an unshown cylindrical bore in the crank 40 and also extends through a similar bore in a block 44 which is rotatably locked to the horizontal pivot 42 by a set screw 45. In this manner the crank 40 and the block 44 will rotate together with the horizontal pivot 42, and this movement of the crank will tip the associated end of the guide roller 22 between position 22A and position 22B. A servo motor 46, incorporating a dead-beat brake mechanism, is secured by set screws 47 to the casing 43 and has its output shaft 48 connected to drive a slipping clutch 49. An output member 50 of the slipping clutch drives a lead screw 51 which passes diametrically through a coacting cylindrical nut 52 having coaxial cylindrical extensions 53 engaging a vertical slot 54 defined by the block 44. In this manner, rotation of the servo motor 46 will normally be transmitted through the slipping clutch 49 to rotate the lead screw 51 and thereby cause the block 44 and crank 40 to tip the guide roller 22 between position 22A and 22B. As the cylindrical nut 52 is constrained by the lead screw 51 to remain in a horizontal plane, the slots 54 enable the block 44 to rise and fall relative to the cylindrical nuts 52. As shown, the lead screw 51 extends from the cylindrical nut 52 through a supporting bore 55 in the opposite side of the casing 43 and is connected by a coupling 56 to a horizontal shaft 57 which is rotatable by a hand wheel 58 as shown in FIG. 1.

Figure 5:
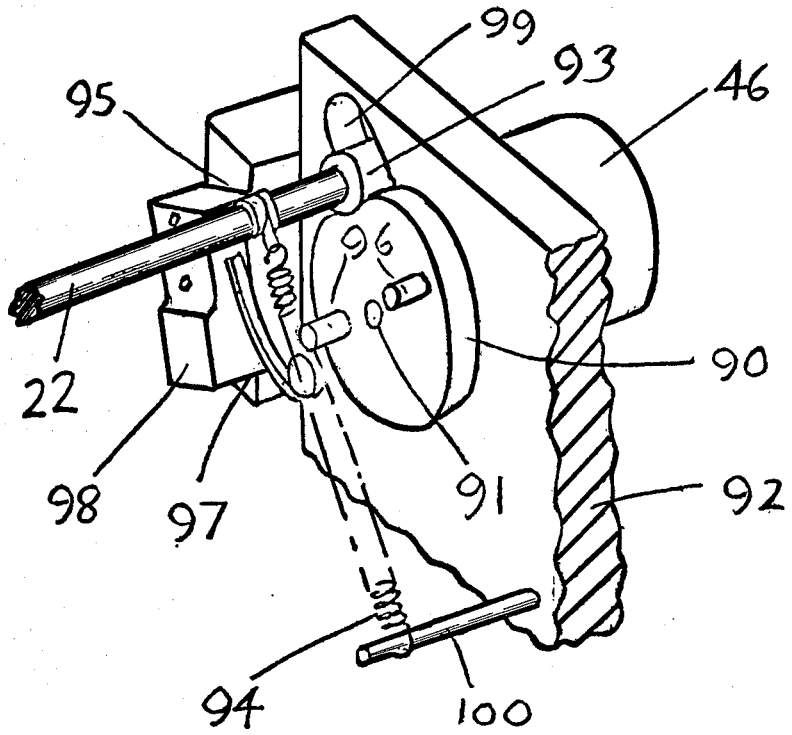
FIG. 5 is a perspective view of an alternative mechanism for tipping the guide roller.

Instead of using the arrangement shown in FIG. 4, the guide roller 22 can be tipped by means of a heart-shaped cam 90 carried by a spindle 91 of a servo motor 46'. The servo motor 46' is mounted on a side plate 92 of the machine, the side plate 92 being formed with a slot 99 for guiding a bearing 93 at one end of the guide roller 22. The bearing 93 is urged into contact with the cam 90 by a spring 94 which extends between a sleeve 95 slidably mounted on the guide roller 22, and a peg 100 on the side plate 92. Two pegs 96 are provided on the cam for operating a lever 97 of a micro-switch 98. In use, the cam is rotated first in one direction then in the other direction to cause the guide roller 22 to tip in alternate directions. Normally the bearing 93 rides over one side only of the cam and over a portion of that side generally midway between the highest and lowest extremities of the cam. If the roll of packaging film, or the film itself, has been incorrectly positioned during the setting up of the machine or for some other reason, excessive tipping of the roller may be necessary in order to move the sheet sideways by the desired amount. If, as a result, the bearing 93 moves too close to one of the extremities of the cam (as shown in FIG. 5), one of the pegs 96 will depress the lever 97 to switch off the servo motor 46' and energise a suitable warning indicator so that an operator can re-set the machine. Should the micro-switch 98 fail to operate, the cam 90 will simply continue turning, and the bearing 93 may ride on both side of the cam. Instead of using a handwheel for manually adjusting the position of the guide roller 22, the cam 90 can be rotated incrementally in either direction by operating suitable switching in a power circuit for the servo motor.

Figure 3:
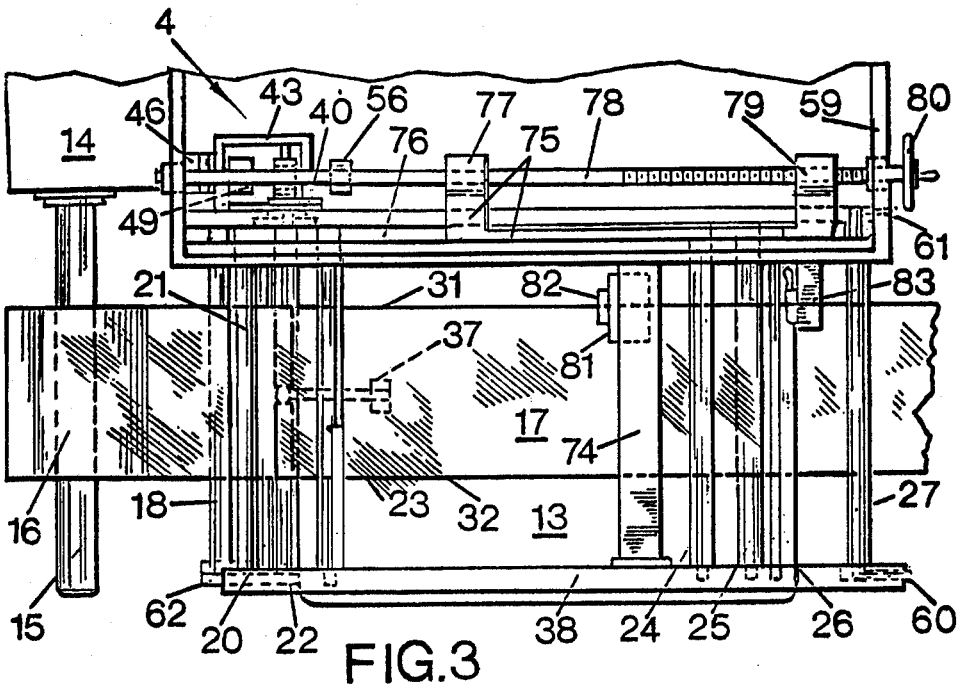
FIG. 3 is a plan view of FIGS. 1 and 2.

The remaining guide rollers 20, 21, 23, 24, 25, 26 and 27 are supported at their one ends by bearings carried by the side plate 38, and at their opposite ends by corresponding bearings carried by a control casing 59. The bearings for the guide roller 27 are mounted in horizontal slides positioned by respective adjustment screws 60 and 61 as shown in FIGS. 1 and 3 so that the guide roller 27 can be positioned correctly relative to the former 28. The ends of the guide roller 18 are supported by similar bearings in a pair of brackets 62 secured to the base portion 11.

Figure 2:
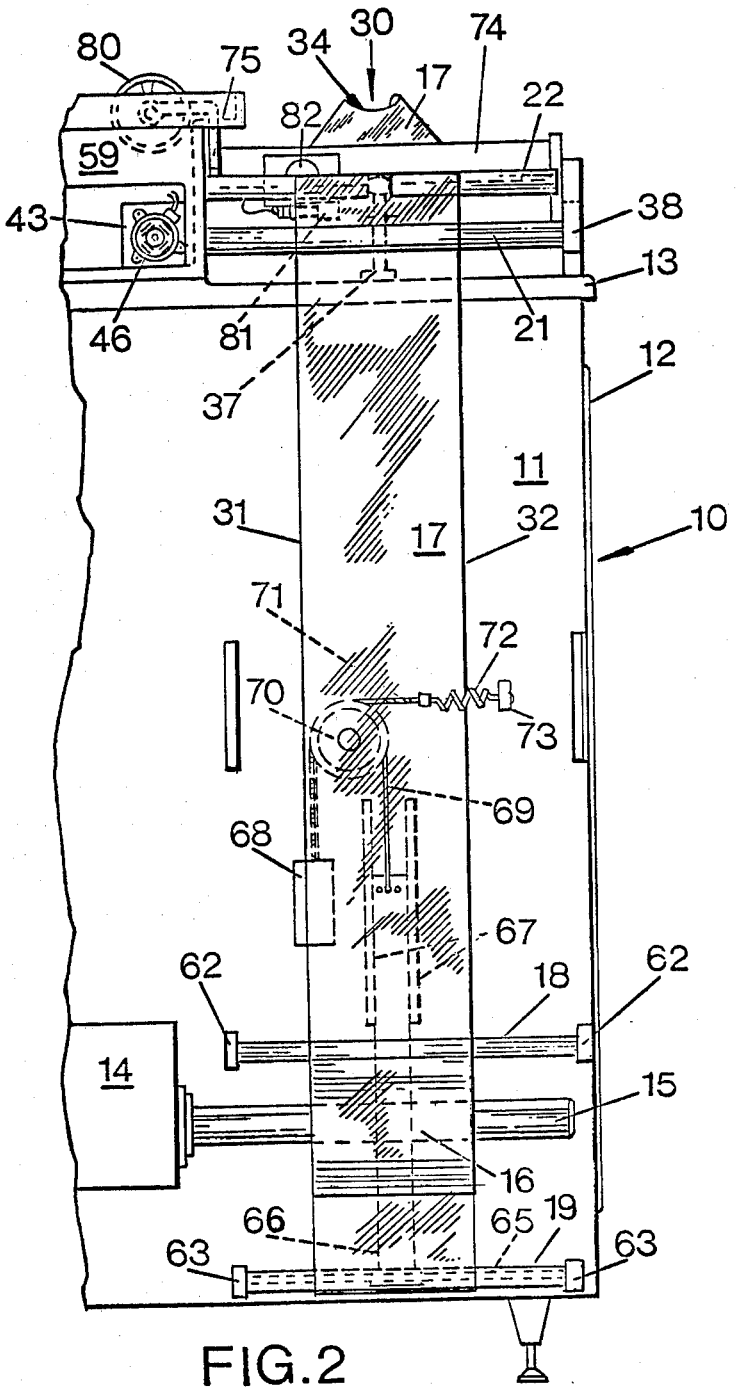
FIG. 2 is a side elevation of FIG. 1 taken in the direction of arrow 2.

The guide roller 19 also has its ends supported by similar bearings in a pair of blocks 63 which are secured by respective plates 64 to the opposite ends of a transverse bar 65. At its centre, the transverse bar 65 is secured to the bottom of a vertical slide 66 which is located by a pair of vertical guides 67 secured to the base portion 11. As shown in FIG. 2, the top of the vertical slide 66 is connected to a counter weight 68 by a flexible bar 69 which passes over a pulley 70 pivoted above a horizontal axis from the base portion 11. A second flexible wire 71 connects the counter weight 68 to a tension spring 72 which is anchored to a bracket 73 secured to the base portion 11. In this manner, when the packing film 17 is drawn through the former 28, the guide roller 19 can rise to prevent excessive tension from being generated in the packaging film 17, the counter balance vertical movement of the guide roller 19 being suitably modified by the tension spring 72.

A bridge member 74 has one end supported in a horizontal slide defined by the side plate 38, its opposite end being secured to an adjustment slide 75 which extends with working clearance through a horizontal slot 76 defined by the control casing 59. As best seen in FIG. 3, one end of the adjustment slide 75 is formed with a boss 77 that is a close sliding fit on a cylindrical surface defined on a horizontal lead screw 78, and the opposite end of the adjustment slide 75 is formed with a threaded boss 79 engaging the threads of the horizontal lead screws 78. A hand wheel 80 is positioned vertically above the previously mentioned hand wheel 58 and serves to rotate the horizontal lead screw 78 for positioning the adjustment slide 75 and consequently the position of the bridge member 74 between the guide rollers 23 and 24. It will be noted that the horizontal lead screw 78 is positioned parallel to and immediately above the servo motor 46 and the associated lead screw 51 and horizontal shaft 57. A photo-electric scanning device 81 is carried by the bridge member 74 to scan the packaging film 17 immediately adjacent its longitudinal edge 31. After the packaging film 17 has been drawn through the former 28 to define a cylindrical tube as shown, the tube will pass an unshown transverse sealing and cutting head which is arranged to flatten the tube transversely, seal the opposite sides together, and then separate the tube transversely through the middle of the transverse seal. In this manner, the top of one bag and the bottom of an adjacent bag are formed simultaneously, each bag being charged with a predetermined quantity of the product delivered through the aperture 30. So that each bag can be provided with advertising or other printed matter, the packaging film 17 is preprinted with a series of labels intended one for each bag. It is of course important to ensure that, when the tube is transversely sealed and severed, the sealing and severing is correctly positioned between adjacent printed labels. For this reason the packaging film 17 is conveniently printed adjacent its longitudinal edge 31 with a regularly spaced series of identification marks corresponding to the spacing of the printed labels. The photo-electric scanning device 81 is arranged to read these identification marks so that the unshown transverse sealing and cutting head of the machine will be properly co-ordinated with the printed labels on the packaging film 17. The hand wheel 80 is therefore rotated to move the photo-electric scanning device 81 longitudinally of the packaging film 17 until the transverse sealing and cutting head is properly co-ordinated with the printed labels on the packaging film 17. To enable different widths of packaging film 17 to be used on the machine, the photo-electric scanning device 81 is horizontally adjustable along the bridge member 74, its position being locked by the set screw 82.

A film detector 83 is mounted from the side of the control casing 59 adjacent the guide roller 26. The film detector 83 is preferably a photo-electric device which will not be affected by ambient light. The photo-electric device is preferably part of a unit including a light emitter, and light from the emitter will be reflected by the surface of the transparent packaging film for identification of the photo-electric device. Thus, the photo-electric device will produce a signal to the effect that the longitudinal edge 31 of the packaging film 17 has either just reached the transverse adjusted position of the film detector 83, or has just left that position. In operation, the hand wheel 58, or switching for the FIG. 5 embodiment, is operated to tilt the guide roller 22 relatively to the other rollers so that it is slightly inclined in one direction. As a result, when the packaging film 17 is drawn over the guide roller 22, it will tend to drift slowly sideways in that direction until its longitudinal edge 31 is identified by the film detector 83 which then generates a detection signal. This signal is used to operate the servo motor 46 or 46' to tilt the guide roller 22 in the opposite direction so that the packaging film 17 moving over the guide roller 22 will then tend to drift slowly sideways in said opposite direction. As soon as the film detector 83 detects that the longitudinal edge 31 of the packaging film 17 is no longer present, a reverse signal is applied to the servo motor 46 or 46' so that the guide roller 22 will then be tilted in said one direction again. It will therefore be appreciated that the packaging film 17 will tend to hunt slowly sideways between the permissible lateral limits which will ensure that the overlap 33 is correctly positioned relative to the stationary sealing head 35.

Various electronic control circuits are required to co-ordinate the operation of the various operations performed by the machine, and these are conveniently arranged to drive the spindles 15 whenever the packaging film 17 is drawn through the former 28. It will be noted that the machine is free standing on individual support legs as shown and can therefore be positioned immediately adjacent a corresponding batch weighing machine.

The film detector 83 may be provided by other detection devices such as fluidic detectors together with the complementary fluidic circuitry. Instead of tipping the roller 22 to control the direction in which the packaging film will be fed towards the former 28, the servo motor 46 or 46' may be repositioned to alter the position of the roll 16 axially of its spindle 15.

What I claim as my invention and desire to secure by Letters Patent of the United States is:

1. A method of guiding an elongate sheet of packaging material towards a former which manipulates the sheet into a tube having its longitudinal edges slighly overlapped to enable them to be formed into a seam, including intentionally causing the sheet to drift sideways in one direction as it is drawn towards the former, detecting when one longitudinal edge of the sheet has drifted to a first predetermined position then causing the sheet to drift sideways in the opposite direction until the said one longitudinal edge of the sheet has drifted to a second predetermined position and then intentionally causing the sheet to drift sideways again in the said one direction.

2. A method, according to claim 1, including providing a plurality of rollers, guiding the sheet over said rollers, and tipping one of the rollers to cause the sheet to drift sideways in either direction.

3. A method, according to claim 2, including sensing when said one longitudinal edge of the sheet reaches said first predetermined position as a result of tipping the roller in one direction, producing a signal to tip the roller in an opposite direction so that the sheet will drift in said opposite direction, sensing when said longitudinal edge of the sheet reaches the second predetermined position, and producing a further signal to tip the roller in said one direction again.

4. Apparatus for guiding an elongate sheet of packaging material towards a former which manipulates the sheet into a tube having its longitudinal edges slightly overlapped to enable them to be formed into a seam, including a guide for moving the sheet sideways in either direction as it is drawn towards the former, a detector for identifying the presence or absence of one longitudinal edge of the sheet, the guide being arranged to move the said one longitudinal edge of the sheet sideways towards the detector, the detector on sensing the presence of the one longitudinal edge of the sheet being arranged to cause a reverse sideways movement of the sheet to occur until the said one longitudinal edge of the sheet is no longer identified by the detector means whereupon the guide will again move the said one longitudinal edge of the sheet sideways towards the detector.

5. Apparatus, according to claim 4, in which the guide includes rollers for guiding the sheet towards the former, one of said rollers being mounted for tipping relatively to the others to cause the sheet to drift sideways in either direction.

6. Apparatus, according to claim 5, in which control means is provided for allowing the inclination of said one roller, the control means being arranged to tip the roller slightly in one direction to cause the said one longitudinal edge of the sheet to drift in that direction towards the detector, the detector on sensing the presence of the one longitudinal edge of the sheet being arranged to operate the control means to reverse the inclination of said one roller whereby the sheet will drift in the opposite direction until the one longitudinal edge of the sheet is no longer identified by the detector whereupon the detector will operate the control means to tip said one roller slightly in the said one direction again.

7. Apparatus, according to claim 6, in which a self-aligning bearing is provided for supporting said one roller at a position remote from said control means, and one end of the said one roller is connected to the control means.

8. Apparatus, according to claim 7, in which the control means is a crank which is driven by a servo motor actuated by the detector, a self aligning bearing being provided at the outer end of the crank for supporting said one roller.

9. Apparatus, according to claim 8, in which the servo motor is connected to the crank through a slipping clutch.

10. Apparatus, according to claim 9, in which a separate manual control is provided for altering the position of the crank.

11. Apparatus, according to claim 6, in which the control means includes a cam having a surface so shaped that movement of the cam will tip the said one roller.

12. Apparatus, according to claim 11, in which the roller is provided with a bearing which engages said cam surface.

13. Apparatus, according to claim 12, in which the bearing end of the one roller is arranged within guide means.

14. Apparatus, according to claim 13, in which means is provided for stopping movement of the cam if an extremity of the cam reaches or moves close to the bearing.

15. Apparatus, according to claim 4, in which a sealing head is provided for forming the seam, and the detector is mounted for adjustment transversely of the sheet of packaging material whereby the overlapped longitudinal edges of the sheet may be adjusted relatively to the sealing head.

16. Apparatus, according to claim 4, in which tensioning means is provided for applying a predetermined tension to the sheet.

* * * * *